US012798033B2

(12) United States Patent
Alshehri et al.

(10) Patent No.: US 12,798,033 B2
(45) Date of Patent: Nov. 17, 2026

(54) TIP SHARPENER

(71) Applicant: KING SAUD UNIVERSITY, Riyadh (SA)

(72) Inventors: Mohammed Abdullah Alshehri, Riyadh (SA); Ibraheem Rshood Alqwizany, Riyadh (SA); Omar Mohammed Alshehri, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 18/939,491

(22) Filed: Nov. 6, 2024

(65) Prior Publication Data

US 2026/0124716 A1 May 7, 2026

(51) Int. Cl.
*B24B 3/60* (2006.01)
*B24D 15/06* (2006.01)

(52) U.S. Cl.
CPC ..... *B24B 3/605* (2013.01); *B24D 15/06* (2013.01)

(58) Field of Classification Search
CPC ..... B24D 15/06; B43L 23/00; B43L 23/004; B43L 23/008; B43L 23/06; B43L 23/08; B43L 23/085; B24B 3/00; B24B 3/26; B24B 3/32; B24B 3/605
USPC ..... 241/83, 85, 86, 91, 94, 95; 30/451, 452, 30/454, 455, 457, 462
See application file for complete search history.

(56) References Cited

U.S. PATENT DOCUMENTS

| | | | | | |
|---|---|---|---|---|---|
| 90,289 | A * | 5/1869 | Myers | B43L 23/08 | 15/427 |
| 418,066 | A * | 12/1889 | Richardson | B43L 23/08 | 30/458 |
| 449,812 | A * | 4/1891 | Boyd | B43L 23/08 | 30/458 |
| 1,026,671 | A * | 5/1912 | Hager | B43L 23/08 | 30/454 |
| 1,306,903 | A * | 6/1919 | Imaizumi | B43L 23/08 | 30/457 |
| 2,485,441 | A * | 10/1949 | Garrett | B43L 23/008 | 144/28.11 |

(Continued)

FOREIGN PATENT DOCUMENTS

| | | | | |
|---|---|---|---|---|
| GB | 706220 A | | 3/1954 | |
| GB | 2040744 A | * | 9/1980 | B24D 15/06 |

(Continued)

*Primary Examiner* — Monica S Carter
*Assistant Examiner* — Kent N Shum
(74) *Attorney, Agent, or Firm* — Nath, Goldberg & Meyer; Joshua B. Goldberg

(57) ABSTRACT

The tip sharpener is a sharpening tool for the tips of instruments, such as the tips of ultrasonic scalers, as a non-limiting example. The tip sharpener includes a body with opposed first and second ends, and with a conical recess formed within the body such that a vertex of the conical recess is closer to the first end than to the second end. A mouth of the conical recess is opposed to the vertex of the conical recess and is formed in the second end of the body. At least one radially extending vent is formed in an outer surface of the body and is in open communication with the conical recess. The conical recess is adapted for receiving a tip of an instrument to be sharpened therein. In use, the tip is inserted with respect to the conical recess to a desired depth and rotated within the conical recess.

3 Claims, 1 Drawing Sheet

(56) References Cited

U.S. PATENT DOCUMENTS

| | | | | | |
|---|---|---|---|---|---|
| 2,519,625 | A * | 8/1950 | Becker | B43L 23/08 | 144/28.11 |
| 3,112,582 | A | 12/1963 | Livet | | |
| 3,250,257 | A * | 5/1966 | Warner | B43L 23/00 | 30/454 |
| 3,626,645 | A | 12/1971 | Rochet | | |
| 4,761,885 | A | 8/1988 | McMillan | | |
| 4,866,810 | A * | 9/1989 | Kudlacek | A47L 25/00 | 30/454 |
| 6,074,293 | A * | 6/2000 | Bleier | B24D 15/06 | 76/82 |
| 7,229,038 | B1 | 6/2007 | Givonetti | | |
| 2008/0132154 | A1* | 6/2008 | Jewett | B24B 19/16 | 451/178 |

FOREIGN PATENT DOCUMENTS

| | | | |
|---|---|---|---|
| GB | 2040744 | B | 9/1982 |
| GB | 2171939 | B | 5/1988 |

* cited by examiner

TIP SHARPENER

BACKGROUND

Field

The disclosure of the present patent application relates to the sharpening of instrument tips, such as, as a non-limiting example, tips of ultrasonic scalers.

Description of Related Art

Sharpeners for instrument tips are relatively well-known. A typical sharpener for an ultrasonic scaler tip uses a diamond bur or the like which is made to rotate to grind the exterior surface of the tip. Such grinding sharpeners rely on the user to be able to create desired angles in the tip using nothing more than manual dexterity and visual observation. For tips used with medical equipment, such as those used with ultrasonic scalers, inaccuracy in the sharpening can render the instrument either dangerous or unusable. Thus, a tip sharpener solving the aforementioned problems is desired.

SUMMARY

The tip sharpener is a sharpening tool for the tips of instruments, such as the tips of ultrasonic scalers, as a non-limiting example. The tip sharpener includes a body with opposed first and second ends, and with a conical recess formed within the body such that a vertex of the conical recess is closer to the first end than to the second end. A mouth of the conical recess is opposed to the vertex of the conical recess and is formed in the second end of the body. At least one radially extending vent is formed in an outer surface of the body and is in open communication with the conical recess. The conical recess is adapted for receiving a tip of an instrument to be sharpened therein. In use, the tip is inserted within the conical recess to a desired depth and rotated with respect to the conical recess. The body is formed from a relatively hard material, such as diamond, as a non-limiting example, so that the tip may be sharpened by abrasion through contact with the walls of the conical recess. In order to aid the user while sharpening the tip, an axle may be mounted on the first end of the body. The axle may be connected to a dental handpiece or the like to drive rotation of the body. Thus, the tip may be held stationary and the body may be driven to rotate about it.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figure 1:
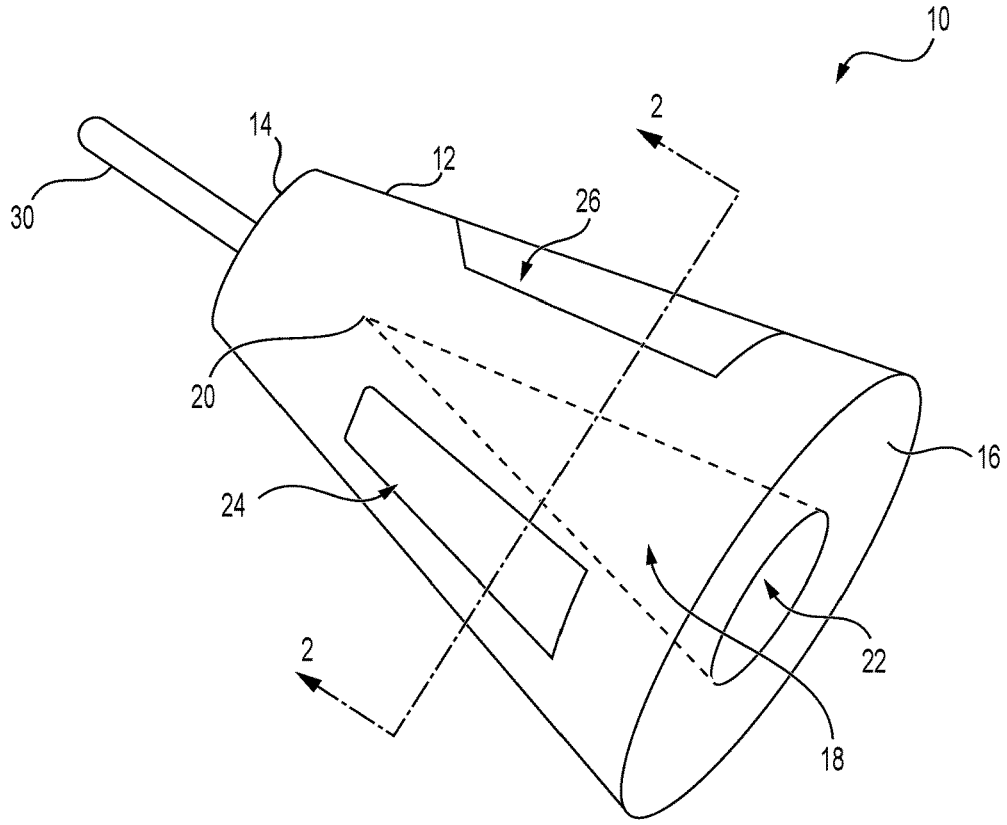
FIG. 1 is a perspective view of a tip sharpener.

The tip sharpener 10 is a sharpening tool for the tips of instruments, such as the tips of ultrasonic scalers, as a non-limiting example. As shown in FIG. 1, the tip sharpener 10 includes a body 12 with opposed first and second ends 14, 16, respectively, and with a conical recess 18 formed within the body 12 such that a vertex 20 of the conical recess 18 is closer to the first end 14 than to the second end 16. Although the non-limiting example of FIG. 1 shows the body 12 as having a frustoconical shape, it should be understood that the overall shape and relative dimensions of body 12 are shown for exemplary purposes only. Similarly, it should be understood that the relative dimensions and positioning of the conical recess 18 are shown for exemplary purposes only.

Figure 2:
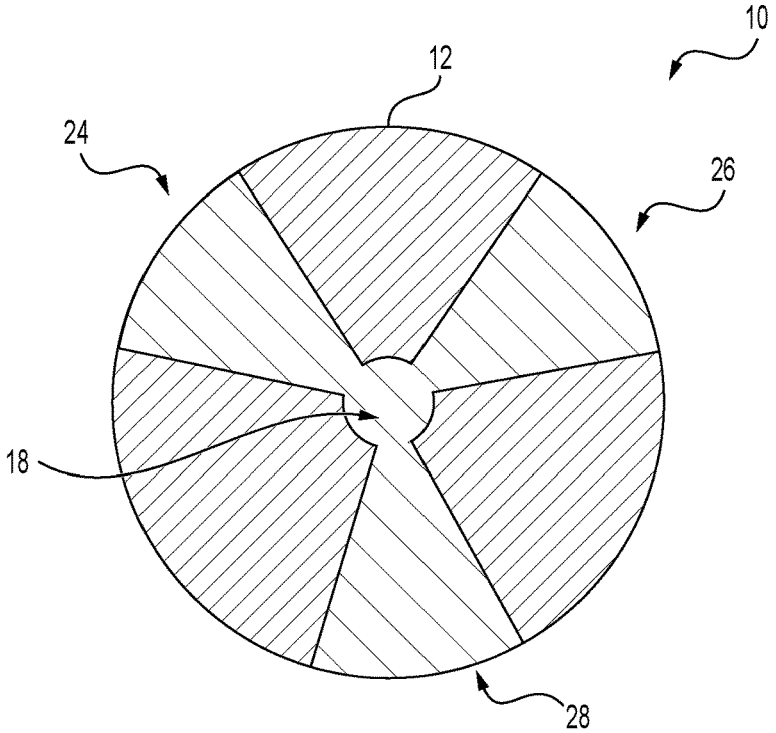
FIG. 2 is a cross-sectional view of the tip sharpener taken along line 2-2 of FIG. 1.

A mouth 22 of the conical recess 18 is opposed to the vertex 20 of the conical recess 18 and is formed in the second end 16 of the body 12. At least one radially extending vent is formed in the outer surface of the body 12 and is in open communication with the conical recess 18. In the cross-sectional view of FIG. 2, three such vents 24, 26 and 28 are shown, however, it should be understood that the number of vents may be varied. Further, the vents 24, 26 and 28 are shown being evenly angularly distributed with respect to the outer surface of the body 12, however, it should be understood that the positioning, overall shapes and relative dimensions of the vents 24, 26 and 28 are shown for exemplary purposes only and may be varied.

The conical recess 18 is adapted for receiving a tip of an instrument to be sharpened therein. In use, the tip is inserted within the conical recess 18 to a desired depth and rotated with respect to the conical recess 18. The body 12 is formed from a relatively hard material, such as diamond, as a non-limiting example, so that the tip may be sharpened by abrasion through contact with the walls of the conical recess 18. It should be understood that multiple tip sharpeners 10 may be provided, each having a conical recess 18 with different dimensions, allowing tips of varying sizes and with varying angles to be sharpened. The vents 24, 26 and 28 provide for cooling of the conical recess 18 and the tip during the sharpening process. In order to aid the user while sharpening the tip, an axle 30 may be mounted on the first end 14 of the body 12, as shown in FIG. 1. The axle 30 may be connected to a dental handpiece or the like to drive rotation of the body 12. Thus, the tip may be held stationary and the body 12 may be driven to rotate about it. It should be understood that the shape and relative dimensions of the axle 30 are shown for exemplary purposes only.

It is to be understood that the tip sharpener is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A tip sharpener, comprising a body having opposed first and second ends, the body having a conical recess formed therein, the conical recess having a vertex closer to the first end than to the second end of the body and a mouth opposed to the vertex, wherein the mouth of the conical recess is formed in the second end of the body, wherein a plurality of radially extending vents is formed in an outer surface of the body and is in open communication with the conical recess, wherein the plurality of radially extending vents has a length extending between the vertex of the conical recess and the mouth of the conical recess, wherein the length of the plurality of radially extending vents is shorter than a length of the conical recess as measured from the vertex thereof to the mouth thereof, such that: a) the vertex of the conical recess is formed by a first portion of the body that excludes the plurality of radially extending vents, and b) a second portion of the body, located directly adjacent to the mouth of the conical recess, omits the plurality of radially extending vents, wherein said first portion of the body that excludes the plurality of radially extending vents is a structure that has a conical sidewall that extends in a length direction of the conical recess, wherein said conical sidewall forms an end portion of the conical recess and said conical sidewall defines the vertex of the conical recess, wherein the conical recess is adapted for receiving a tip to be sharpened therein, wherein the plurality of radially extending vents is configured to cool the body having the conical recess and to cool the tip during a sharpening process of the tip, wherein the body has a frustoconical shape, wherein the plurality of vents comprises three vents, wherein the tip sharpener further comprises an axle mounted to the first end of the body, wherein an entirety of the axle is cylindrical, wherein the first end of the body comprises a flat surface, and the entirely cylindrical axle protrudes from the flat surface of the first end of the body, wherein the flat surface of the first end of the body forms an edge where it intersects an outer surface of the entirely cylindrical axle, and wherein the flat surface of the first end of the body forms an edge where it intersects an outer surface of the body.

2. The tip sharpener as recited in claim 1, wherein the three vents are evenly angularly distributed with respect to the outer surface of the body.

3. The tip sharpener as recited in claim 1, wherein the body comprises diamond.

* * * * *